US008418480B2

(12) United States Patent
Danley et al.

(10) Patent No.: US 8,418,480 B2
(45) Date of Patent: Apr. 16, 2013

(54) COOLING SYSTEM USING POSITIVE DISPLACEMENT CRYOGENIC LIQUID PUMP

(75) Inventors: Robert L. Danley, Collingswood, NJ (US); Patrick Traini, West Chester, PA (US)

(73) Assignee: Waters Technologies Corporation, Milford, MA (US)

( * ) Notice: Subject to any disclaimer, the term of this patent is extended or adjusted under 35 U.S.C. 154(b) by 771 days.

(21) Appl. No.: 12/338,501

(22) Filed: Dec. 18, 2008

(65) Prior Publication Data

US 2010/0154439 A1 Jun. 24, 2010

(51) Int. Cl.

| | |
|---|---|
| ***F17C 3/08*** | (2006.01) |
| ***F17C 13/02*** | (2006.01) |
| ***F04B 37/00*** | (2006.01) |
| ***F04B 43/00*** | (2006.01) |
| ***F04B 39/00*** | (2006.01) |

(52) U.S. Cl.
USPC ..... 62/50.6; 62/45.1; 62/49.1; 62/49.2; 417/468; 417/472; 417/554

(58) Field of Classification Search ..... 62/45.1, 62/49.1, 49.2, 50.1, 50.2, 50.6; 417/472, 417/468, 554
See application file for complete search history.

(56) References Cited

U.S. PATENT DOCUMENTS

| | | | | |
|---|---|---|---|---|
| 3,456,490 | A | 7/1969 | Stone | |
| 3,572,084 | A | 3/1971 | May | |
| 3,938,347 | A * | 2/1976 | Riedel et al. | 62/49.2 |
| 4,031,740 | A | 6/1977 | Achermann | |
| 4,783,174 | A | 11/1988 | Gmelin et al. | |
| 4,902,206 | A * | 2/1990 | Nakazawa et al. | 417/394 |
| 4,979,896 | A | 12/1990 | Kinoshita | |
| 5,013,159 | A | 5/1991 | Nakamura et al. | |
| 5,117,639 | A | 6/1992 | Take | |
| 5,308,230 | A * | 5/1994 | Moore | 417/394 |
| 5,419,140 | A * | 5/1995 | Germain | 62/49.2 |
| 5,876,118 | A * | 3/1999 | Vogel | 374/11 |
| 6,523,998 | B1 * | 2/2003 | Danley et al. | 374/12 |
| 6,578,367 | B1 * | 6/2003 | Schaefer et al. | 62/51.1 |

(Continued)

OTHER PUBLICATIONS

Article by J. G. Van-de-Velde, J.D. Mitchell/Thermochimica, Acta 214 (1993), pp. 163-170.

(Continued)

*Primary Examiner* — Frantz F. Jules
*Assistant Examiner* — Henry Crenshaw

(57) ABSTRACT

A cooling system employs a single-acting positive displacement bellows pump to transfer a cryogenic liquid such as liquid nitrogen from a storage dewar to a heat exchanger coupled to a measurement chamber of an instrument, wherein cooling takes place by vaporizing the liquid. Preferably, the capacity of the pump is greater than the maximum cooling requirement of the instrument, wherein both vapor resulting from vaporizing of the cryogenic liquid circulated through the heat exchanger and liquid that does not vaporize when circulated through the heat exchanger are returned to the storage dewar, wherein the vapor is subsequently vented from the dewar. Preferably, with the aid of a weir in a return line, the level of liquid in the heat exchanger is maintained full and constant, and the cooling demands are automatically met without the need for other control of the flow rate or level of the liquid. Also, unlike conventional systems, liquid transfer from the dewar does not require dewar pressurization, so that the dewar may be refilled whenever necessary without interrupting the experiment in progress.

22 Claims, 4 Drawing Sheets

U.S. PATENT DOCUMENTS

| | | | | |
|---|---|---|---|---|
| 2002/0092357 | A1* | 7/2002 | Theriault et al. | 73/760 |
| 2003/0110937 | A1* | 6/2003 | Lang et al. | 92/72 |
| 2003/0115894 | A1* | 6/2003 | Podtchereniaev et al. | 62/217 |
| 2004/0223669 | A1* | 11/2004 | Vicars | 384/11 |
| 2005/0005626 | A1* | 1/2005 | McMahon | 62/293 |
| 2005/0031475 | A1* | 2/2005 | Taniguchi | 417/472 |
| 2005/0145562 | A1* | 7/2005 | Allen et al. | 210/519 |
| 2005/0203415 | A1* | 9/2005 | Garlick et al. | 600/463 |
| 2005/0245841 | A1* | 11/2005 | Turturro et al. | 600/562 |
| 2007/0213699 | A1* | 9/2007 | Baust et al. | 606/22 |
| 2007/0237658 | A1* | 10/2007 | Burns et al. | 417/417 |

OTHER PUBLICATIONS

Article by Guy K. White, "Experimental Techniques in Low-Temperature Physics" 3rd Ed., 1979, Oxford Science Publications, pp. 50-54.

Ebisu, Takeo et al.; "Small pump for liquid nitrogen"; Rev. Sci. Instrum. 59(4), Apr. 1988, pp. 658-659.

Simane, C. et al.; "A Small Transfer and Distribution System for Liquid Nitrogen"; Acta Polytechnica vol. 41, No. 1/2001, pp. 29-30.

* cited by examiner

COOLING SYSTEM USING POSITIVE DISPLACEMENT CRYOGENIC LIQUID PUMP

This application claims the benefit of U.S. Provisional Application No. 60/015,731, filed Dec. 21, 2007, which is herein incorporated by reference in its entirety.

BACKGROUND

1. Field of the Invention

The present invention is related to apparatus for cooling samples and more particularly to cooling systems that use expendable evaporating coolants.

2. Background of the Invention

Sample measurements, such as those conducted for thermal analysis experiments, frequently involve performing measurements at temperatures that are below the ambient temperature of a measuring instrument used to conduct the experiment. This requires that at least a portion of the instrument be cooled, such as a sample stage region used to hold the sample. The sample stage region is cooled by providing a heat exchange means (heat exchanger) in a region adjacent and thermally coupled to it or as part of the region that holds the sample. Coolant is then provided to the heat exchanger to remove heat from the sample region.

Generally, cooling systems designed for such purposes may be divided into those that use expendable coolants like liquid nitrogen, and those that recirculate a coolant, such as those that use vapor-compression refrigeration. In cases in which liquid nitrogen is used as a coolant, there are broadly two different approaches, which may be divided into (1) those that cool a sample stage by using cold vapor to cool the apparatus by convective heat transfer and (2) those that use liquid nitrogen to cool the apparatus by boiling heat transfer. Systems using convection cooling are relatively inefficient because the latent heat of vaporization, which has by far the greater cooling effect per unit mass of coolant, is not used to cool the apparatus. Also, considerably lower temperatures may be achieved using boiling heat transfer as compared to convective cooling. Using convection cooling it is often difficult to reach −150° C., while systems that use boiling heat transfer cooling can readily achieve −180° C. without any particular difficulty.

Often, the choice of convection heat transfer using vapor rather than boiling heat transfer is made based on the method of temperature control of the instrument, and not based on considerations of maximizing cooling efficiency. This is due to differences in the nature of the two heat exchange processes. When using convection cooling, heat transfer between the vapor and a heat exchanger depends directly upon the flow rate of the vapor. At low flow rates, the temperature change experienced by the vapor is large and the cooling effect is low, while at high flow rates, the temperature change experienced by the vapor is lower, but the cooling effect is much greater; thus, one may regulate the cooling effect by changing the flow rate of the vapor. In the boiling heat transfer process, the liquid in a heat exchanger is always essentially at the boiling point of the saturated liquid and the vapor that is created from the liquid is also very close to the boiling point. Thus, increases in flow rate have very little effect on the magnitude of heat exchange, so that adjusting the flow rate of the liquid does not appreciably change the amount of heat removed, as long as the volume of boiling liquid in the heat exchanger remains constant.

Boiling heat exchange involves the formation of vapor bubbles on a surface of the heat exchanger, wherein the bubbles detach from the surface and carry away heat in the process. As the heat flux across the heat exchange surface increases, the rate of bubble formation increases. Eventually, if the rate of heat exchange continues to increase, the surface becomes almost completely covered with vapor bubbles and the rate of heat exchange reaches a maximum. At that point, the critical heat flux (also termed "critical heat flux point" or "critical heat flux level" hereinafter) is reached, and further increases in heat flux cause the temperature of the heat exchanger to rise rapidly, as the rate of heat flux across the surface drops. The critical heat flux is an unstable point, above which the heat flux across the surface drops as the surface temperature rises. To avoid the instability associated with reaching the critical heat flux, cooling systems that use boiling heat exchange are designed to always operate below the point of critical heat flux, which requires that a boiling heat exchange cooling system always operates with a constant level of liquid in the heat exchanger. It is therefore desirable that the heat exchanger is designed to have enough surface area such that the critical heat flux is not exceeded when maximum power is developed in the instrument being cooled. It is also desirable that a pump used to deliver liquid to the heat exchanger is designed to deliver more liquid than necessary to replenish liquid that boils during the heat exchange process, including transfer losses of liquid, i.e., liquid that boils in the transfer line between the pump and the heat exchanger. Thus, for an instrument that uses boiling heat transfer cooling, during an experiment it is paramount that the liquid level in the heat exchanger remains constant to maintain the heat exchanger in a stable boiling regime below the critical heat flux. Regulation of the flow rate of coolant is of lesser concern.

Known systems that employ a dewar as a source of liquid nitrogen coolant (see, for example U.S. Pat. No. 6,578,367 to Schaefer, et al.; U.S. Pat. No. 5,117,639 to Take; U.S. Pat. No. 5,013,159 to Nakamura, et al.; U.S. Pat. No. 4,979,896 to Kinoshita; U.S. Pat. No. 4,783,174 to Gmelin, et al.; U.S. Pat. No. 4,031,740 to Achermann; U.S. Pat. No. 3,572,084 to May; U.S. Pat. No. 3,456,490 to Stone, which are all incorporated by reference herein in their entirety, and see J. G. Van-de Velde, J. D. Mitchell, Thermochimica Acta, 214 (1993) 163-170) are configured to pressurize the dewar to transfer the nitrogen coolant, in either liquid or gas form, to the heat exchanger during an experiment. In most cases, the dewar is pressurized by using nitrogen gas evolved during evaporation of the liquid in the dewar. Two variations are generally used: 1) a heater is immersed in the liquid nitrogen and is used to boil a portion of the liquid, such that the expansion of the generated vapor pressurizes the dewar; and 2) a tube connecting the bottom of the dewar to the gas space at the top of the dewar is passed between the inner and outer walls of the dewar, such that liquid flowing into the tube boils. The resulting vapor enters the top of the dewar, thereby pressurizing the dewar.

When a pressurized dewar is used to transfer liquid to a heat exchanger, the gas pressure in the dewar forces the liquid to enter a transfer tube that extends downward into the dewar, terminating just above the bottom of the dewar. The liquid flows upward through the transfer tube by which the liquid is conducted to the sample region thereby providing a cooling medium to cool the sample during an experiment. When the pressurized dewar is used to transfer gas, the transfer tube is connected to the gas space above the liquid in the dewar and the pressure in the dewar forces the cold gas to flow through the transfer tube to the experiment. In either case, refilling the dewar with liquid nitrogen is required periodically to replenish the liquid nitrogen lost to the gas phase during an experiment. Refilling the dewar requires that it be vented to atmosphere to allow vapor generated during filling and displaced by the liquid to be discharged to atmosphere. Thus, the pressure necessary for delivering coolant to a heat exchanger located near the sample during the experiment must be released each time the dewar is refilled.

When the pressure from the dewar is released, the desired cooling effect at the heat exchanger is disrupted. For example, in a boiling heat exchange system, as mentioned above, it is paramount that the level of liquid be maintained at a certain level to avoid heat exchange instability. Once the transfer line conducting liquid to the sample heat exchanger is depressurized due to depressurization of the dewar, the circulation of the liquid through the heat exchanger slows down or stops, and the liquid in the heat exchanger boils, reducing the liquid level, potentially causing the critical heat flux to be exceeded which destroys the ability to control the sample temperature as desired. Because of this problem, an experiment must generally be terminated for refilling of a pressurized dewar. This limits the maximum duration of experiments that may be performed using known pressurized dewar systems and/or requires that the experimental schedule allow for refilling the dewar.

SUMMARY OF THE INVENTION

In one embodiment of the present invention, a thermal analysis cooling system is configured to transfer the cryogenic liquid from a storage dewar without pressurization of the cryogenic liquid to a heat exchanger by using a positive displacement pump that is submerged within the cryogenic liquid. The system is configured to provide a cryogenic liquid that cools an experimental sample by vaporization of the cryogenic liquid within the heat exchanger. The pump is preferably configured with a low pressure drop suction check valve and is preferably configured to operate at constant speed, such that a relatively constant and continuous flow rate of liquid is provided to the heat exchanger. To prevent the point of critical heat flux from being reached, the constant flow rate is larger than the flow rate necessary to accommodate the maximum heat load of the instrument. The system is further configured to return vapor generated in the heat exchanger and excess liquid to the dewar, and configured to vent the returned vapor to the atmosphere as well as to collect the returned liquid in the dewar, wherein the returned liquid is available to be pumped back to the heat exchanger. Because pressure from vapor in the dewar is not used to transfer liquid to the heat exchanger, the thermal analysis cooling system of the present invention allows liquid to be added to the dewar at any time, including during an experiment when liquid is being actively circulated to the heat exchanger from the dewar, thereby providing a continuous source of sample cooling for any desired length of time.

In another embodiment of the present invention, a cryogenic liquid cooling system comprises a dewar configured to store a cryogenic liquid, a positive displacement pump configured to pump the cryogenic liquid in the dewar through a transfer line as a continuous flow as long as the positive displacement pump is submerged within the cryogenic liquid, and a drive assembly that is mechanically coupled to the positive displacement pump. The drive assembly is configured to provide a reciprocating motion to the positive displacement pump, and is configured to attach to the dewar cover, whereby the drive assembly is disposed outside the dewar during operation of the positive displacement pump.

In a further embodiment of the present invention, a cryogenic liquid cooling system for providing continuous cooling to a sample stage comprises a positive displacement pump configured to pump the cryogenic liquid contained in a storage dewar through a discharge tube as a continuous flow as long as the positive displacement pump is submerged within the cryogenic liquid, and a heat exchanger thermally coupled to the sample stage. The heat exchanger is configured to receive the cryogenic liquid pumped from the transfer line, to transfer heat from a sample stage coupled to the heat exchanger which is cooled by vaporization of the cryogenic liquid, and to return unvaporized cryogenic liquid and vapor evolved from the cryogenic liquid to the dewar.

In yet another embodiment of the present invention, a cryogenic liquid cooling system for cooling a sample stage of an experimental apparatus comprises a dewar configured to store a cryogenic liquid, a positive displacement pump configured to pump the cryogenic liquid in the dewar through a transfer line as a continuous flow as long as the positive displacement pump is submerged within the cryogenic liquid, a drive assembly mechanically coupled to the positive displacement pump, configured to introduce a reciprocating motion into the positive displacement pump, and configured to mount to a cover on the outside of the storage dewar, and a heat exchanger configured to receive the cryogenic liquid from the transfer line and to maintain a predetermined level of cryogenic liquid in the heat exchanger during operation of the positive displacement pump.

DETAILED DESCRIPTION

FIGS. 1-4 below depict aspects of the present invention in which the components are configured to provide a continuous supply of cryogenic liquid to a heat exchanger when a pump is submerged within an unpressurized liquid. The terms "unpressurized liquid" or "liquid in an unpressurized state" refer to the fact that an excess pressure is not exerted upon a cryogenic liquid (for example, when the liquid is in a storage dewar), so that the pressure above the cryogenic liquid is similar to that of the atmosphere outside the dewar. Accordingly, as described in detail below, a bellows pump of the present invention is configured to operate to pump cryogenic liquid in a dewar that contains one or more vent portals communicating with the ambient atmosphere outside the dewar, such that at least one portal can remain open to the atmosphere to allow excess vapor to vent to the outside atmosphere during operation of the pump. The pressure in the dewar is therefore maintained at a level that is approximately that of the outside atmosphere.

Thus, unlike positively pressurized cryogenic cooling systems, no excess pressure above the cryogenic liquid is needed for the positive displacement pump of the present invention to operate so that vent portals need not remain sealed. This facilitates replenishing the dewar with cryogenic liquid without interrupting operation of the pump, since the pump can remain operational as long as the pump remains submerged in liquid. This allows refilling of liquid into the unpressurized dewar, by, for example, opening a portal in the dewar and transferring of liquid nitrogen from a source, such as a bulk storage dewar.

Figure 1:
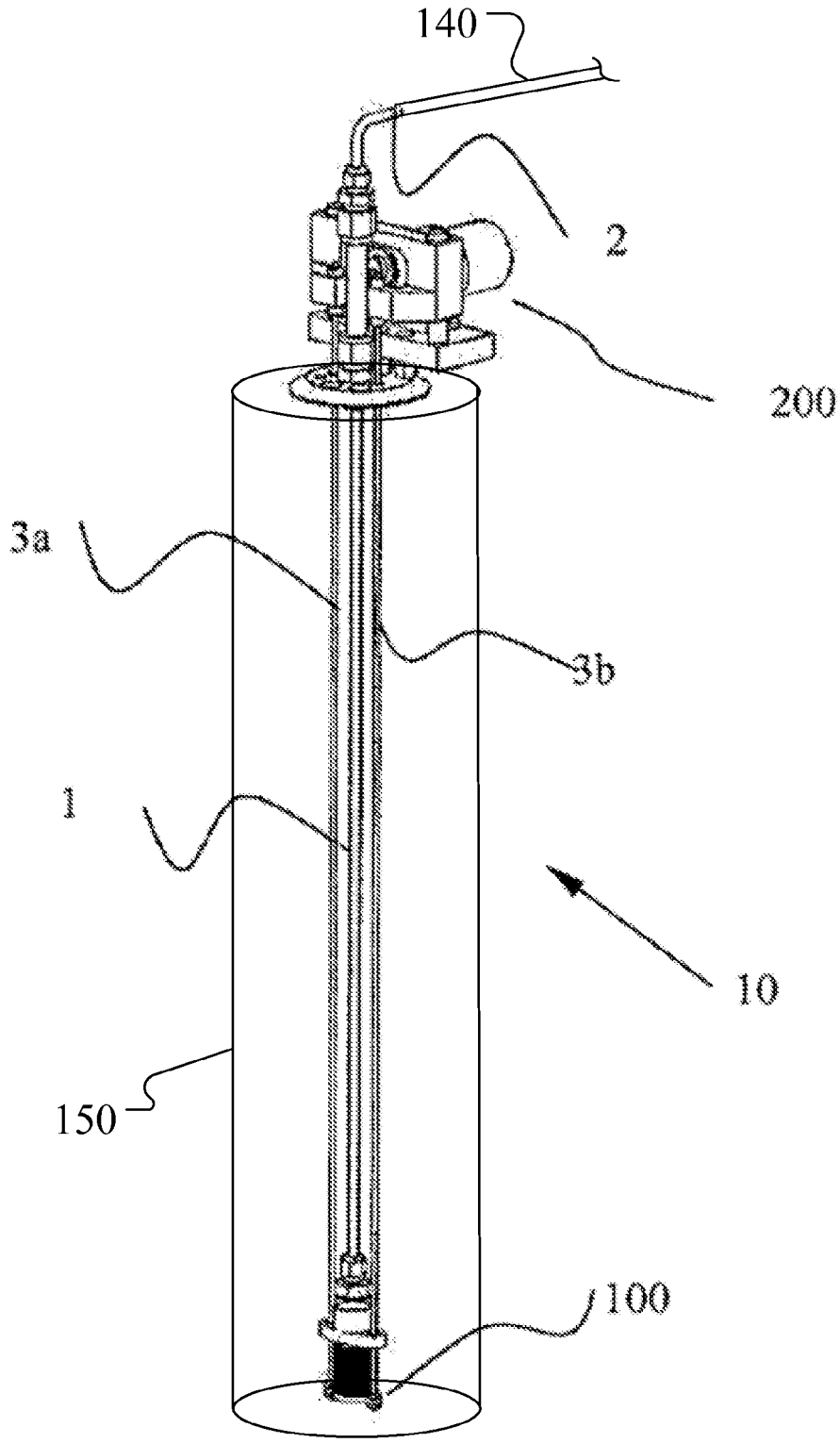
FIG. 1 shows an axonometric view of a liquid nitrogen pump assembly including a bellows pump assembly, drive assembly, drive rods and discharge tube, in accordance with an embodiment of the present invention.

In accordance with an embodiment of the present invention, FIG. 1 shows an overall view of a liquid nitrogen pump system 10 comprising bellows pump assembly 100, drive assembly 200, discharge tube 1 and drive rods 3*a* and 3*b*. Bellows pump assembly 100 is connected to drive assembly 200 by discharge tube 1 through which liquid nitrogen can flow. Discharge tube 1 has an end 2 that is connected to a transfer line 140 that conducts liquid nitrogen to the apparatus to be cooled. Drive assembly 200 supports bellows pump assembly 100 via discharge tube 1, which is made of a rigid material and serves to maintain a fixed separation between drive assembly 200 and the top of pump assembly 100. Drive rods 3 *a* and 3*b* connect bellows pump assembly 100 to drive assembly 200 and impart the reciprocating motion of the drive assembly to the pump assembly.

Figure 2:
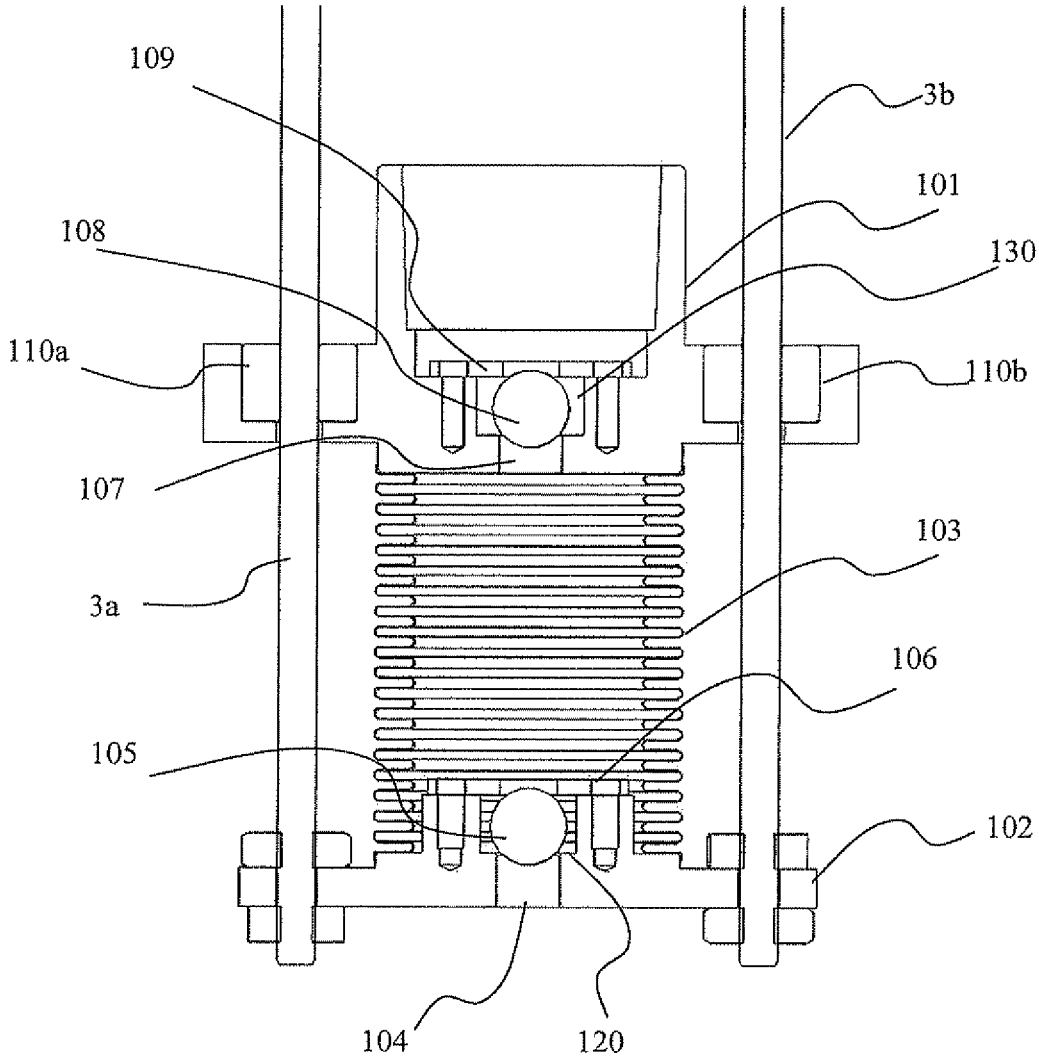
FIG. 2 shows a side view cross section of the bellows pump depicted in FIG. 1, in accordance with an embodiment of the present invention.

FIG. 2 is a vertical cross sectional view through bellows pump assembly 100, showing details of its construction. The pump assembly comprises outlet head 101, which contains a discharge port 130, preferably configured as a discharge check valve assembly; inlet head 102, which contains an inlet port 120 that is preferably configured as a suction check valve assembly; and bellows 103. Outlet head 101 is connected to bellows 103, which, in turn, is connected to inlet head 102. The connections between the bellows and outlet and inlet heads are made using a liquid tight method that prevents liquid from leaking. In an exemplary embodiment of the invention, the inlet and outlet heads are made from stainless steel, the bellows is made from electrodeposited nickel, and the bellows and inlet and outlet heads are joined together by soldering. However, in other embodiments of the present invention, the inlet and outlet heads, as well as the bellows can be made from other materials that do not become brittle at cryogenic temperatures and may be joined using methods other than soldering.

Outlet head 101 is connected in a liquid tight manner to discharge tube 1 (not shown in FIG. 2), which is configured to support the pump assembly 100 (see FIG. 1) and hold it motionless during operation of the pump. Inlet head 102 is connected to drive rods 3*a* and 3*b*, which move parallel to the axis of the pump and impart the reciprocating motion of the drive assembly to the inlet head, thereby alternately compressing and extending the bellows and causing the volume enclosed by the outlet and inlet heads and the bellows to alternately decrease and increase. As noted above, inlet head 102 preferably includes a suction check valve 120, which comprises inlet port 104, check ball 105, and check ball retainer 106. The discharge port 130 is preferably a discharge check valve assembly that comprises discharge port 107, check ball 108, and check ball retainer 109.

As depicted in FIG. 2, bellows 103 extends and compresses along a vertical axis. FIG. 2 depicts a position of the pump in which both check valves are closed, which occurs both at the point of maximum compression and the point of maximum extension of the bellows 103. Extension of the bellows causes liquid in the dewar 150 to enter the pump through suction port 104, displacing check ball 105 against the force of gravity; check ball retainer 106 limits check ball motion so that during the compression stroke the check ball closes the suction port under the action of gravity and the tendency of liquid to flow backward through the suction port, thereby preventing liquid from flowing back out of the pump through suction port 104. In a preferred embodiment of the present invention, suction check valve 120 is configured as a very low pressure drop ball check valve. This denotes that very little pressure drop is required to cause the valve to open to permit cryogenic liquid to flow through it. By thus configuring the suction check valve 120 to open with low pressure drop, the pressure drop on the cryogenic liquid is minimal during each pump cycle when liquid is drawn into the bellows.

The low pressure drop configuration using a ball check valve promotes improved operation of the pump within the cryogenic liquid because the tendency to form vapor in liquid entering or leaving the pump is minimized. Cryogenic liquid in an unpressurized dewar has a temperature close to the boiling point of the liquid. Accordingly, slight increases in temperature inside the dewar tend to markedly increase vaporization. Similarly, significant pressure drops induced above the cryogenic liquid, such as those caused by a large pressure drop check valve, would induce a large increase in the rate of vaporization of the cryogenic liquid passing through the check valve. Thus, in accordance with the present invention, a low pressure drop check valve reduces the amount of vapor evolved during each cycle of the pump by minimizing the pressure drop experienced by the liquid flowing through the check valves.

Compression of the bellows forces liquid contained within the pump to leave the pump through discharge port 107, displacing check ball 108 against the force of gravity; check ball retainer 109 limits check ball motion so that during the extension stroke check ball 108 closes the discharge port 107 under the action of gravity and the tendency of liquid to flow backward through the discharge port, thereby preventing liquid from flowing back into the pump. Drive rods 3*a* and 3*b* pass through guide bushings 110*a* and 110*b* that are installed in the outlet head. The bushings allow free motion of the drive rods but constrain them to move parallel to the axis of the bellows, thereby stabilizing the bellows.

Figure 3:
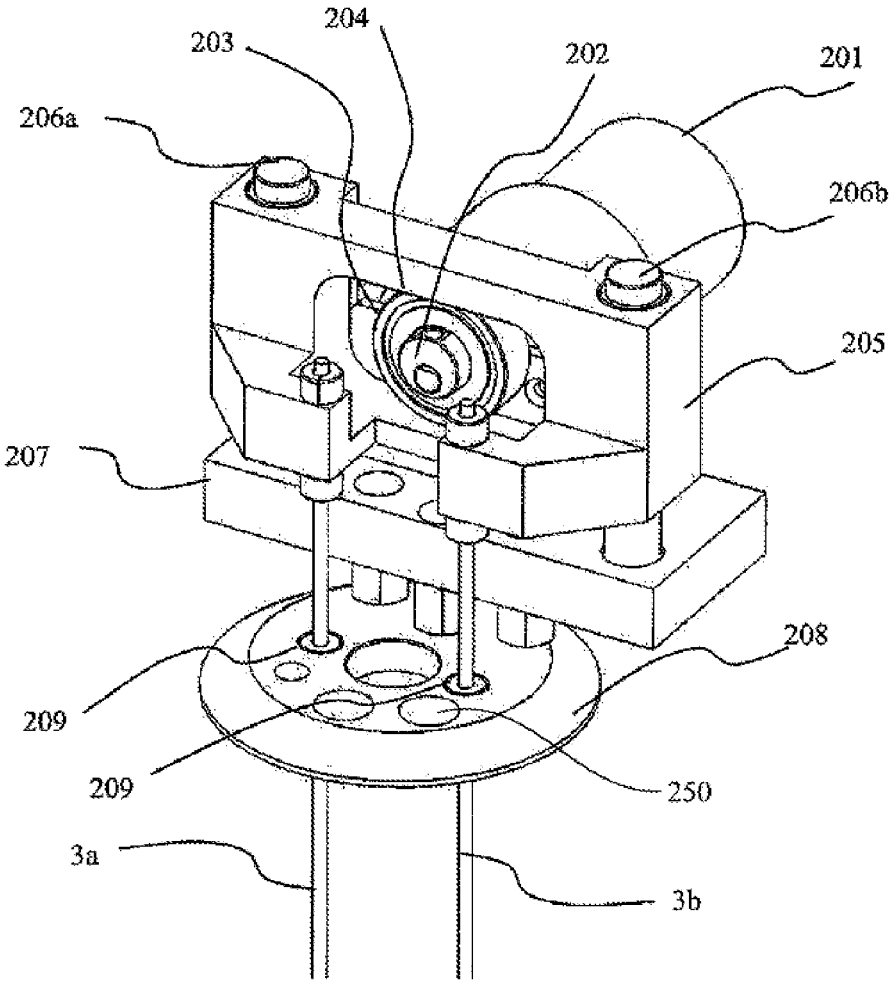
FIG. 3 shows an axonometric view of the drive assembly depicted in FIG. 1, according to an embodiment of the present invention.

FIG. 3 shows an axonometric view of drive assembly 200. Gearmotor 201 has an eccentric 202 mounted on its output shaft; an antifriction bearing 203, such as a ball bearing, is mounted on the eccentric. The outer race of the ball bearing engages a slot 204 in crosshead 205 which is guided by a pair of shafts, 206*a* and 206*b* that constrain the crosshead to move parallel to the axes of the shafts, which are parallel to the axes of the pump and the drive rods. Shafts 206 and gearmotor 201 are mounted on plate 207. When the motor is energized, ball bearing 203 rotates eccentrically on the gear motor output shaft, creating a reciprocating motion of the crosshead in a direction parallel to shafts 206. Crosshead 205 is fixedly attached to drive rods 3*a* and 3*b*, so that the reciprocating motion of the crosshead imparts a reciprocating motion to the drive rods 3*a* and 3*b* and thereby to the pump. Mounting plate 207 is attached to cover 208, which is configured to clamp to the neck of a dewar containing the liquid. Drive rods 3*a* and 3*b* are configured to pass through cover 208 and move freely in an up-and-down motion with respect to cover 208. Cover 208 includes vent portals 250. In one embodiment of the present invention, bushings 209 installed in plate 208 comprise a graphite material that facilitates smooth reciprocal motion of the drive rods 3*a*, 3*b* through cover 208 over many pump cycles.

Thus, during operation of pump assembly 10, drive system 200 is located external to the dewar, while bellows pump assembly 100 is immersed in the liquid in the dewar and is driven by system 200 via rods 3*a* and 3*b*, which are free to move with respect to cover 208.

In accordance with the present invention, the overall distance between plate 208 and bellows pump assembly 100 is tailored according to the size of the dewar to be used. In one embodiment of the present invention, separate liquid nitrogen pump assemblies 10 can be provided, wherein in each assembly 10, the lengths of drive rods 3*a*, 3*b* and discharge tube 1 are configured to locate bellows pump assembly 100 near the bottom of a dewar into which the bellows pump is to be immersed when cover 208 is clamped to the top of the dewar. Accordingly, the lengths of drive rods 3*a*, 3*b* and discharge tube 1 could be for example one foot for use with a small dewar, or could be several feet for use with a larger dewar, or any other suitable length.

Figure 4:
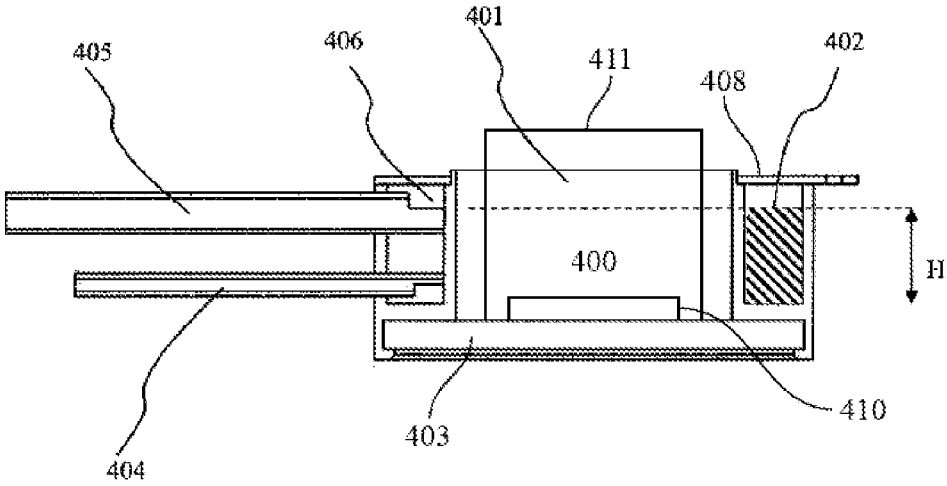
FIG. 4 shows a cross-section of a heat exchanger for a thermal analysis instrument that may be employed with the pump assembly of FIG. 1, according to another embodiment of the present invention.

FIG. 4 shows a cross sectional view through a heat exchanger 400 that may be used to cool a thermal analysis or other instrument, in accordance with an exemplary embodiment of the present invention. The body 401 of the heat exchanger is preferably in the form of a ring made of high thermal conductivity material, and contains an annular cavity 402 to receive the coolant. The walls and the floor of the cavity comprise the heat exchange surface. In the exemplary embodiment shown, body 401 comprises a lower body 407 that includes the walls and floor of the annular cavity and a cover plate 408 that is soldered to the body and which forms the top of the annular cavity. Heat exchanger 400 incorporates a mounting surface 403, by which it may be coupled to a thermal analysis apparatus 411, for example, to a sample stage 410 of the apparatus 411. Liquid is supplied to the annular cavity 402 by an inlet tube 404 that discharges liquid into the annular cavity. Inlet tube 404 is connected to end 2 of the discharge tube of the pump by a suitable conduit (not shown). Preferably, vapor and excess liquid is discharged from the heat exchanger by exhaust tube 405 that is connected to the dewar by a suitable conduit (not shown) to return the mixture of liquid and vapor to the dewar. The discharge tube is constructed with a weir 406, over which liquid leaving the heat exchanger must flow, thereby regulating the level of liquid in the heat exchanger to be about the same height H or slightly higher than the top of the weir.

In the embodiment illustrated in FIG. 4, heat exchanger 400 is in the form of a ring to accommodate a device coupled to heat exchanger 400, such as the device disclosed in U.S. Pat. No. 6,523,998 to Danley, et. al. In accordance with embodiments of the present invention, the exact structure of the heat exchanger is tailored according to the thermal interface of the instrument to which it is coupled. Features common to any such heat exchanger include a cavity to contain the liquid having wetted heat exchange surfaces that are sufficiently large such that adequate heat can be exchanged, a mounting surface to attach the heat exchanger to the instrument, and inlet and outlet connections to the heat exchanger. In other embodiments of the present invention, the heat exchanger can be an integral part of the instrument to be cooled, such that it is inseparable with the instrument.

In accordance with a preferred embodiment of the present invention, a pump system and heat exchanger, such as those described with respect to FIGS. 1-4 above, are configured to supply a continuous flow of cryogenic liquid to the heat exchanger that is sufficient to compensate for a maximum heat load applied to the heat exchanger. This denotes the fact that the continuous flow of cryogenic liquid is sufficient to remove heat from the heat exchanger by boiling heat transfer at a rate that is sufficient to prevent the critical heat flux point from being reached even under maximum heat load.

Advantageously, with the use of a positive displacement pump having low pressure drop suction and discharge check valves immersed in an unpressurized dewar, continuous flow of liquid can be supplied to a heat exchanger for any desired length of time, since the dewar can be refilled without stopping the pump. In accordance with embodiments of the present invention, in order to assure that the continuous cryogenic liquid flow is sufficient to prevent the critical heat flux point from being reached, the overall size and shape of the heat exchanger can be tailored according to the expected or measured heat load applied to a sample stage. For example, a heat exchanger can be configured such that the critical heat flux point is not reached so long as the exchanger remains full of liquid (say, up to the weir height).

In particular, referring again to FIG. 4, in accordance with embodiments of the present invention, the annular cavity 402 and the position of weir 406 used for boiling heat exchange in heat exchanger 400 is designed such that the heat exchange area of heat exchanger 400 is sufficient to maintain operation below the critical heat flux point. When the liquid level in annular cavity is full, that is, is at the level H of weir 406, the heat exchange area corresponds to the area of the surfaces of annular cavity 402 that are contacted by liquid, as depicted in the hatched region of FIG. 4. For a given experimental system, a contact area that is sufficient for operation of heat exchanger 400 below the critical flux level can be calculated or estimated. This contact area can be achieved in heat exchanger 400 by choice of the size and shape of the annular cavity 402 and the relative height H of weir 406 with respect to annular cavity 402. As noted above, when annular cavity 402 is filled with liquid, the liquid reaches height H, facilitating easy calculation of the heat exchange area when heat exchanger 400 is operated with full liquid, based upon the depth of liquid and cavity diameter.

Accordingly, assuming the design of heat exchanger 400 provides sufficient heat exchange area when annular cavity 402 is full to height H, during an experiment, the positive displacement pump of the present invention need thereby only operate to provide sufficient liquid flow rate such that some liquid is continuously returned to the dewar, thus ensuring that liquid remains in the heat exchange cavity up to the height of the weir. This requires no active control system that may be complicated to operate, and allows for variations in flow rate, so long as the flow rate is sufficient to maintain some liquid return to the dewar at all times.

Thus, although the flow rate of cryogenic liquid through the heat exchanger may vary as the bellows pump cycles from an expanded state to a compressed state, in accordance with embodiments of the present invention, the stroke (back and forth distance traveled by the bellows) and diameter of the bellows, the diameter and length of lines conducting the cryogenic liquid, and the depth of the heat exchange cavity containing the liquid, among other factors, can be tailored to ensure that the heat exchange cavity remains full of liquid, such that liquid is returned to the dewar at all points of the pump cycle and under all heat flux conditions anticipated for the sample stage.

In this regard, an advantage afforded by the heat exchanger 400 of the present invention is that cryogenic liquid used to cool heat exchanger 400 is recirculated from heat exchanger 400 back to a dewar from which the liquid is obtained. Accordingly, unlike a heat exchange using cryogenic liquid that vents to atmosphere after heat exchange, a pump, such as pump assembly 100, can be conveniently operated to supply an excessive flow rate of liquid, such that a substantial flow of cryogenic liquid is returned to the dewar after passing through heat exchanger 400. Accordingly, the return of liquid to the dewar in systems designed according to the present invention need not be closely monitored, since moderate fluctuations in pumping speed, for example, would be unlikely to reduce the cryogenic liquid flow rate to the point that no liquid is returned and the liquid in the heat exchange cavity begins to deplete. In contrast, in systems venting to atmosphere after liquid passes through the heat exchanger, operation of pumps at flow rates that create an excessive return of cryogenic liquid would result in a substantial waste of cryogenic liquid. However, for such systems, operation of pumps at flow rates that minimize cryogenic liquid return in order to avoid liquid waste could risk decreasing heat exchange area if the rate of delivery of liquid to the heat exchanger fluctuates such that no liquid is returned and the level of liquid in a heat exchange cavity begins to drop.

In accordance with an embodiment of the present invention, pump system 10 is also fitted with a system (not shown) to detect the level of liquid nitrogen in the storage dewar. Such a system for liquid level detection can be of known designs. For example, one embodiment of the present invention comprises a liquid level detection system that contains a pair of self-heated thermal switches that close when immersed in liquid nitrogen and open when surrounded by vapor. One of the switches is mounted in the dewar at an elevation corresponding to the full level of liquid and closes to indicate that the dewar is full. The other switch is located at an elevation corresponding to the level at which the dewar should be refilled and opens to indicate that it should be refilled. The switches may simply provide a level indication, for example, by illuminating indicating lamps, or may be used to operate a valve by which liquid may be automatically added to the dewar to refill it. Alternatively, a continuous level measuring system, such as a capacitive level detection (see Guy K. White, "Experimental Techniques in Low-Temperature Physics" 3rd Ed., 1979, Oxford Science Publications, pp 50-54) system may be used. The capacitive level detection system may simply provide level indication via a meter or other suitable indicating device. Alternatively, the detection system may be used to supply a level indication to a logical circuit that actuates a valve by which liquid may be automatically added to the dewar when the liquid level falls to a preset value.

The foregoing disclosure of the preferred embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. For example, the present invention may be used in conjunction with any system that requires a sample stage or other apparatus or device to be cooled using a cryogenic liquid. The scope of the invention is to be defined only by the claims appended hereto, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. A cryogenic liquid cooling system, comprising:

a dewar configured to store unpressurized cryogenic liquid, said dewar comprising at least one vent portal for venting the cryogenic liquid in the dewar to the ambient atmosphere outside the dewar;

a positive displacement pump configured to pump the unpressurized cryogenic liquid from the dewar through a transfer line without interruption when the positive displacement pump is submerged within the cryogenic liquid; and a drive assembly mechanically coupled to the positive displacement pump, wherein the drive assembly is configured to provide a reciprocating motion to the positive displacement pump, and wherein the drive assembly is configured to attach to the dewar, whereby the drive assembly is disposed outside the dewar during operation of the positive displacement pump;

a heat exchanger comprising an annular cavity for receiving the cryogenic liquid;

a sample stage of a scientific instrument coupled to the heat exchanger by being mounted on a mounting surface in a central cavity of the heat exchanger, said heat exchanger configured to:

receive the cryogenic liquid pumped through the transfer line into the annular cavity; transfer heat away from the mounting surface and thus from the sample stage of the scientific instrument, wherein heat is transferred away from the mounting surface and thus from the sample stage of the scientific instrument by vaporization of the cryogenic liquid within the annular cavity in the heat exchanger; wherein the positive displacement pump operates to supply a continuous flow of cryogen to the heat exchanger that is sufficient to compensate for a maximum heat load applied to the heat exchanger by the sample stage and return unvaporized cryogenic liquid and vapor evolved from the cryogenic liquid to the dewar, wherein the at least one portal remains open to the atmosphere to allow excess cryogen vapor to vent to the outside atmosphere during operation of the pump; wherein the heat exchanger includes an exhaust tube configured such that a level of cryogenic liquid in the heat exchanger during operation corresponds an elevation of the exhaust tube.

2. The cooling system of claim 1, wherein the cooling system is configured to supply the cryogenic liquid to the heat exchanger at a flow rate that is sufficient to keep cryogenic liquid at a full level in the heat exchanger.

3. The cooling system of claim 1, wherein the positive displacement pump comprises:

a bellows;

an inlet head containing an inlet port configured to receive liquid into the pump when the bellows is extended; and an outlet head containing a discharge port coupled to the transfer line and configured to discharge cryogenic liquid from the pump when the bellows is compressed, wherein the inlet port is configured to close when the bellows is compressed, and wherein the discharge port is configured to close when the bellows is extended.

4. The cooling system of claim 3, wherein the inlet port is a suction check valve assembly and the discharge port is a discharge check valve assembly.

5. The cooling system of claim 3, wherein the outlet head and inlet head comprise stainless steel, and the bellows comprises nickel.

6. The cooling system of claim 1, wherein the drive assembly is configured to attach to a cover of the dewar, whereby the drive assembly is disposed outside the dewar during operation of the positive displacement pump.

7. The cooling system of claim 1, wherein the drive assembly comprises:

a motor affixed to a mounting plate;

an eccentric mounted to an output shaft of the motor; an antifriction bearing mounted on the eccentric and configured to engage a crosshead;

a pair of drive rods substantially parallel to each other, the drive rods each affixed to the crosshead on respective upper ends, and each affixed to the positive displacement pump inlet head on respective lower ends, wherein, when the motor is energized, the antifriction bearing rotates eccentrically on the motor output shaft, wherein a reciprocating motion is imparted to the crosshead and thereby to the drive rods and to the positive displacement pump along a direction parallel to the drive rods.

8. The cooling system of claim 7, further comprising a pair of shafts affixed to the mounting plate, the shafts being parallel to the pair of drive rods, wherein the crosshead is constrained to move parallel to an axis of the drive rods, wherein the antifriction bearing is configured to engage a slot in the crosshead, and wherein the motor is a gear motor.

9. The cooling system of claim 1, wherein the cryogenic liquid is liquid nitrogen.

10. A cryogenic liquid cooling system for providing continuous cooling to a sample stage of a scientific instrument, comprising:

a dewar configured to store unpressurized cryogenic liquid, said dewar comprising at least one vent portal for venting the cryogenic liquid in the dewar to the atmosphere;

a positive displacement pump configured to pump the cryogenic liquid stored in a storage dewar through a transfer line as a continuous flow as long as the positive displacement pump is submerged within the cryogenic liquid; and a heat exchanger comprising an annular cavity, and a central cavity wherein a mounting surface in the central cavity is thermally coupled to the sample stage of the scientific instrument and the heat exchanger is configured to: receive the cryogenic liquid pumped from the transfer line; transfer heat from the sample stage coupled to the mounting surface by vaporization of the cryogenic liquid within the annular cavity; and return unvaporized cryogenic liquid and vapor evolved in the annular cavity from the cryogenic liquid to the dewar;

wherein the at least one vent portal remains open to the atmosphere to allow excess vapor to vent to the outside atmosphere during operation of the pump;

wherein cryogenic liquid is returned to the dewar through a discharge tube at all points of the pump's cycle; and a weir disposed in the discharge tube, wherein a level of the cryogenic liquid in the annular cavity during operation of the positive displacement pump corresponds to a height of the weir.

11. The cryogenic liquid cooling system of claim 10, wherein the cryogenic liquid cooling system is configured to supply the cryogenic liquid to the heat exchanger at a flow rate at least sufficient to balance a maximum heat load supplied by the sample stage.

12. The cryogenic cooling system of claim 11, wherein the wherein the positive displacement pump comprises:

a bellows;

an inlet head containing a suction check valve assembly configured to receive liquid into the pump when the bellows is extended; and an outlet head containing a discharge check valve assembly coupled to the transfer line and configured to discharge cryogenic liquid from the pump when the bellows is compressed, wherein the suction check valve assembly is configured to close when the bellows is compressed, and wherein the discharge check valve assembly is configured to close when the bellows is extended.

13. The cryogenic liquid cooling system of claim 10, further comprising a drive assembly mechanically coupled to the positive displacement pump, wherein the drive assembly is configured to provide a reciprocating motion to the positive displacement pump, and wherein the drive assembly is configured to attach to a cover outside the dewar during operation of the positive displacement pump.

14. The cryogenic cooling system of claim 10, wherein the cryogenic liquid is liquid nitrogen.

15. A cryogenic liquid cooling system for cooling a sample stage of a scientific instrument, comprising:

a dewar configured to store a cryogenic liquid;

a positive displacement pump configured to pump the cryogenic liquid in the dewar through a transfer line as a continuous flow as long as the positive displacement pump is submerged within the cryogenic liquid; and a drive assembly mechanically coupled to the positive displacement pump, configured to introduce a reciprocating motion into the positive displacement pump, and configured to mount to a cover on an outside of the storage dewar, said cover comprising at least one vent portal for venting the liquid nitrogen in the dewar to the atmosphere;

a heat exchanger comprising an annular cavity for receiving cryogenic liquid and a central cavity with a mounting surface; and wherein the mounting surface is thermally coupled to the sample stage of the scientific instrument and the annular cavity is configured to receive cryogenic liquid from the transfer line and maintain a predetermined level of cryogenic liquid during operation of the positive displacement pump, said heat exchanger transferring heat by vaporization of the cryogenic liquid within the annular cavity in the heat exchanger, wherein the pump is configured to supply an excessive flow of cryogenic liquid to the cavity in the heat exchanger, such that a continuous flow of liquid is returned to the dewar after passing through the heat exchanger.

16. The cryogenic liquid cooling system of claim 15, wherein the cryogenic liquid comprises liquid nitrogen.

17. The cryogenic liquid system of claim 15, wherein the heat exchanger is configured to return unvaporized liquid and vapor evolved from the cryogenic liquid to the dewar.

18. The cryogenic liquid system of claim 15, wherein the positive displacement pump comprises: a bellows; an inlet head containing a suction check valve assembly configured to receive liquid into the pump when the bellows is extended; and an outlet head containing a discharge check valve assembly coupled to the transfer line and configured to discharge cryogenic liquid from the pump when the bellows is compressed, wherein the suction check valve assembly is configured to close when the bellows is compressed, and wherein the discharge check valve assembly is configured to close when the bellows is extended.

19. The cryogenic liquid cooling system of claim 15, wherein the drive assembly comprises: a motor affixed to a mounting plate; an eccentric mounted to an output shaft of the motor; an antifriction bearing mounted on the eccentric and configured to engage a crosshead; a pair of drive rods substantially parallel to each other, the drive rods each affixed to the crosshead on respective upper ends, and each affixed to the positive displacement pump inlet head on respective lower ends, wherein, when the motor is energized, the antifriction bearing rotates eccentrically on the motor output shaft, wherein a reciprocating motion is imparted to the crosshead and thereby to the drive rods and to the positive displacement pump along a direction parallel to the drive rods.

20. A cryogenic liquid cooling system, comprising:

a dewar configured to store unpressurized cryogenic liquid, said dewar comprising at least one vent portal for venting the liquid nitrogen in the dewar to the atmosphere;

a positive displacement pump configured to pump the unpressurized cryogenic liquid from the dewar through a transfer line without interruption when the positive displacement pump is submerged within the cryogenic liquid, wherein the positive displacement pump comprises:

a bellows;

an inlet head containing an inlet port configured to receive liquid into the pump when the bellows is extended; and an outlet head containing a discharge port coupled to the transfer line and configured to discharge cryogenic liquid from the pump when the bellows is compressed, wherein the inlet port is configured to close when the bellows is compressed, and wherein the discharge port is configured to close when the bellows is extended;

a drive assembly mechanically coupled to the positive displacement pump, wherein the drive assembly is configured to provide a reciprocating motion to the positive displacement pump;

a heat exchanger comprising an annular cavity for receiving cryogenic liquid, and a central cavity with a mounting surface wherein said mounting surface is thermally coupled to the sample stage of the scientific instrument and the annular cavity is configured to receive cryogenic liquid from the transfer line and maintain a predetermined level of cryogenic liquid during operation of the positive displacement pump, said heat exchanger transferring heat by vaporization of the cryogenic liquid within the annular cavity in the heat exchanger, said positive displacement pump supplying a continuous flow of cryogenic liquid to the heat exchanger; and said annular cavity has a discharge tube conveying a continuous flow of liquid cryogen to the dewar.

21. The cooling system of claim 20, wherein the drive assembly is configured to attach to the dewar, whereby the drive assembly is disposed outside the dewar during operation of the positive displacement pump.

22. The cooling system of claim 20, wherein the inlet port is a suction check valve assembly that comprises:

a suction port configured to pass liquid into the pump when the bellows is extended;

a check ball configured to reversibly cover the suction port, wherein during extension of the bellows the check ball is displaced from the suction port; and a check ball retainer configured to limit motion of the check ball, wherein when the bellows is compressed the check ball closes the suction port, wherein the discharge port is a discharge check valve assembly that comprises:

a discharge port configured to pass liquid from the pump when the bellows is compressed;

a second check ball configured to reversibly cover the discharge port, wherein during compression of the bellows the second check ball is displaced from the discharge port;

a second check ball retainer configured to limit motion of the second check ball, wherein when the bellows is extended the second check ball closes the discharge port.

* * * * *